US006742579B1

(12) United States Patent
Levitin et al.

(10) Patent No.: US 6,742,579 B1
(45) Date of Patent: Jun. 1, 2004

(54) FREEZING PLATE

(76) Inventors: Mikhail Levitin, P.O. Box 102, Reeders, PA (US) 18352; Boris Khaytin, P.O. Box 102, Reeders, PA (US) 18352

( * ) Notice: Subject to any disclaimer, the term of this patent is extended or adjusted under 35 U.S.C. 154(b) by 0 days.

(21) Appl. No.: 10/345,464

(22) Filed: Dec. 30, 2002

(51) Int. Cl.[7] ..... F28F 3/12
(52) U.S. Cl. ..... 165/168; 165/177
(58) Field of Search ..... 165/168, 170, 165/177

(56) References Cited

U.S. PATENT DOCUMENTS 1,443,189 A * 1/1923 Malm ..... 165/170
2,051,769 A * 8/1936 Keighley ..... 62/516
6,032,726 A * 3/2000 Wright et al. ..... 165/109.1
6,354,002 B1 * 3/2002 Wright et al. ..... 29/890.03
6,357,522 B2 * 3/2002 Dienhart et al. ..... 165/183
2001/0054502 A1 * 12/2001 Hornschemeyer ..... 165/168

FOREIGN PATENT DOCUMENTS

GB 2040435 A * 8/1980 ..... 165/168

* cited by examiner

*Primary Examiner*—Allen Flanigan

(57) ABSTRACT

The present invention provides improvement of the heat exchange process for freezing plates by achieving approximately uniform temperature on the entire surface of the device and equal heat exchange at the top and the bottom of the plate. These goals are realized when the channels with refrigerant flow are placed at an angle to the bottom side of the plate. In this case heat exchange at the top surface of the device is not limited by the size of the channels' lateral sides and even the collection of refrigerant vapor on the top of the channel takes place.

4 Claims, 1 Drawing Sheet

FREEZING PLATE

The present invention relates to a heat exchange device, and particularly, to a plate for a plate freezer.

BACKGROUND OF THE INVENTION

Freezing plates with fluid flow inside of them usually are used as effective heat exchangers for cold treatment of different foodstuffs. It is necessary to provide the same temperature at different parts of the surface of the plate for effective preservation of the products such as foodstuffs, medication, etc.

In the heat exchange device disclosed in U.S. Pat. No. 6,354,002 by Wright et al. liquid flows through channels connected in series inside the device. The temperature on the surfaces of said device is different. Moreover, the heat exchange at the bottom of the device is higher than at the top due to the accumulation of the vapor at the top of the channel and the small space for heat exchange on the lateral sides of the channel. Therefore, the effectiveness of said device is not efficient.

Accordingly, a need exists for a device that provides an effective heat exchange for better preservation of products such as foodstuffs, medications, etc.

SUMMARY OF THE INVENTION

The present invention provides improvement of the heat exchange process for freezing plates.

The achievement of approximately uniform temperature on the entire surface of the device and approximately equal heat exchange at the top and the bottom of the plate is possible when channels with refrigerant flow are placed at an angle (except 0, 90, and 180 degrees) to the bottom side of the plate. In this case heat exchange at the top surface of the device is not limited by the size of the channels' lateral sides even though the collection of refrigerant vapor on the top of the channel takes place. The form of the channel's cross-section can be polygonal, out-of-round, cross-shaped, star-shaped, and any combinations of these sections or their parts or can have a cross-section of a combination of round forms and the aforementioned shaped cross-sections or their parts.

According to the second embodiment of the present invention, additional channels without refrigerant are placed between the channels with refrigerant flow in order to reduce the weight of the device. The form of these channels' cross-section can be polygonal, out-of-round, cross-shaped, star-shaped, and any combinations of these sections or their parts or forms and the aforementioned shaped cross-sections or their parts.

The above described and many other features and attendant advantages of the present invention will become apparent as the invention becomes better understood by reference to the following detailed description when considered in conjunction with the accompanying drawings.

DESCRIPTION OF THE DRAWINGS

A detailed description of the preferred embodiment of the invention will be made with reference to the accompanying drawings.

DETAILED DESCRIPTION OF THE DRAWINGS

The following is a detailed description of the best presently known mode of carrying out the invention. This description is not to be taken in a limiting sense, but is made merely for the purpose of illustrating the general principles of the invention. The scope of the invention is detailed by the appended claims.

Figure 1:
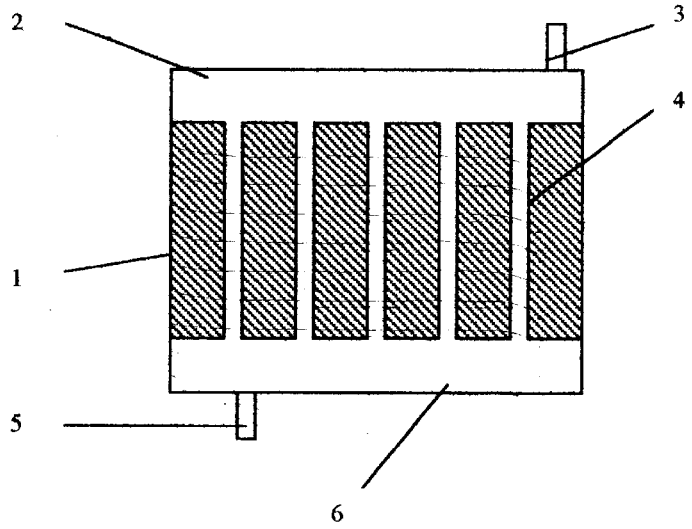
FIG. 1 shows the heat exchange device according the first embodiment of the present invention.
Figure 2:
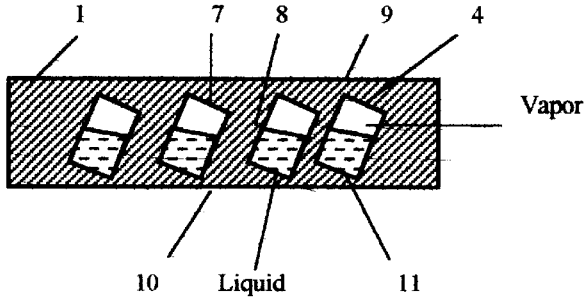
FIG. 2 shows the cross-section through the heat device according to the first embodiment of the present invention.

The heat exchange device shown in FIG. 1 and FIG. 2 is comprised of a body 1 with top 9 and bottom 10 sides, respectively, internal channels 4 with a cross-sectional height greater than the width including top 7, bottom 11, lateral side 8, respectively, supply header 6 with inlet 5, and discharge header 2 with outlet 3.

Figure 4:
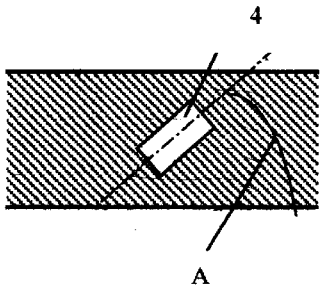
FIG. 4 shows the position of the channel with an angle A to the bottom side of the plate.

Refrigerant enters the supply header 6 through inlet 5 and flows through channels 4 inside body 1. Part of the refrigerant in channels 4 is evaporated and vapor is accumulated at the top 7 of channels 4. Due to the slope of channels 4 in relationship to the bottom 10, the heat exchange from the top 9 of the device is not limited by the surface of channels 4 and lateral sides 8, even though the accumulation of the refrigerant vapor at top 7 of channel 4 takes place. Therefore, the heat exchange along the surface of the device is approximately the same, and heat exchange on top 9 is almost the same as on the bottom 10 of the device. The mixture of vapor and liquid refrigerant flows out of the discharge header 2 through outlet 3. The angle A of the channel (see FIG. 4) varies from 0.01 to 179.99 degrees, excluding 90 degrees.

Figure 3:
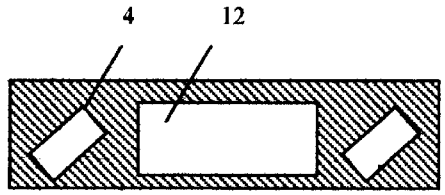
FIG. 3 shows the cross-section through the heat device according the second embodiment of the present invention.

According to the second embodiment of the present invention (see FIG. 3) additional channels 12 without a refrigerant flow are placed between channels 4 with a refrigerant flow and are designed to reduce the weight of the device. The form of these channels' cross-section can be polygonal, out-of-round, cross-shaped, star-shaped, and any combinations of these sections or a combination of round forms and the aforementioned shaped cross-sections or their parts.

Although the present invention has been described above in terms of the preferred embodiments, numerous modifications and/or additions to the above-described preferred embodiments would be readily apparent to one skilled in the art. It is intended that the scope of the present invention extends to all such modifications and/or additions and that the scope of the present invention is limited solely by the claim set forth below.

We claim:

1. A freezing plate comprised of a body, with a top and a bottom, internal rectangular channels including a top, a bottom, and lateral sides, a supply header with an inlet, and discharge header with an outlet while said channels are sloped to said bottom of said body.

2. A freezing plate according to claim 1 while said slope angle of the channels to said bottom of said body varies from 0.01 to 44.99 degree.

3. A freezing plate according to claim 1 with additional channels without refrigerant flow, and which are placed between said channels with refrigerant flow.

4. A freezing plate according to claim 1 with additional channels while the form of said channel's cross-section is polygonal, out-of-round, cross-shaped, star-shaped, and any combinations of these sections or their parts or cross section of a combination of round forms and the aforementioned shaped cross sections or their parts.

* * * * *